US008246039B2

(12) United States Patent
Koga et al.

(10) Patent No.: US 8,246,039 B2
(45) Date of Patent: Aug. 21, 2012

(54) SHEET FEEDING APPARATUS AND IMAGE FORMING APPARATUS

(75) Inventors: Hiroto Koga, Abiko (JP); Hisakazu Okubo, Moriya (JP); Shinsuke Ubayashi, Kashiwa (JP); Yusuke Imai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 12/507,982

(22) Filed: Jul. 23, 2009

(65) Prior Publication Data

US 2010/0032893 A1 Feb. 11, 2010

(30) Foreign Application Priority Data

Aug. 8, 2008 (JP) ..... 2008-206041

(51) Int. Cl.
*B65H 5/00* (2006.01)

(52) U.S. Cl. ..... 271/10.03; 271/4.03; 271/10.01

(58) Field of Classification Search ..... 271/10.03, 271/10.05, 4.03, 110
See application file for complete search history.

(56) References Cited

U.S. PATENT DOCUMENTS

| | | | | |
|---|---|---|---|---|
| 4,844,638 | A * | 7/1989 | Kagami et al. | 400/636 |
| 5,072,924 | A * | 12/1991 | Sugiyama | 271/110 |
| 5,199,696 | A * | 4/1993 | Kato | 271/10.13 |
| 5,478,066 | A | 12/1995 | Yoshida et al. | 271/12 |
| 5,722,652 | A | 3/1998 | Yoshida et al. | 271/11 |
| 6,082,728 | A | 7/2000 | Ubayashi | 271/108 |
| 6,651,980 | B2 | 11/2003 | Isemura et al. | 271/259 |
| 6,804,473 | B2 | 10/2004 | Nakamura et al. | 399/16 |
| 6,823,154 | B2 | 11/2004 | Koga et al. | 399/110 |
| 6,955,348 | B2 | 10/2005 | Koga | 271/97 |
| 7,396,175 | B2 * | 7/2008 | Ueda | 400/708 |
| 2008/0247774 | A1 | 10/2008 | Koga | 399/97 |

FOREIGN PATENT DOCUMENTS

JP 5-338837 12/1993

* cited by examiner

*Primary Examiner* — Kaitlin Joerger
*Assistant Examiner* — Ernesto Suarez
(74) *Attorney, Agent, or Firm* — Fitzpatrick, Cella, Harper & Scinto

(57) ABSTRACT

The present invention provides a sheet feeding apparatus and an image forming apparatus in which generation of a hollow at a separation roller can be prevented.

A sheet separating and feeding portion 132 which separates and feeds sheets S one by one sent by a pickup roller 129 includes a feed roller 130 and a retard roller 131 which is arranged rotatably in the direction opposite to a sheet feeding direction and which is capable of rotating along with a rotation of the feed roller 130 while being press-contacted to the feed roller 130. Then, the feed roller 130 is rotated by a predetermined amount so as to rotate the retard roller 131 via the sheet S after job completion.

6 Claims, 9 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and in particular, relates to the configuration of a sheet separating and feeding portion which separates and feeds sheets one by one to an image forming portion.

2. Description of the Related Art

Recently, an image forming apparatus such as a printer, a copying machine and a facsimile machine includes a sheet feeding apparatus for separating and feeding sheets one by one to an image forming apparatus. Such a sheet feeding apparatus includes a sheet separating and feeding portion for separating and feeding the sheets one by one.

As such a sheet separating and feeding portion, a retard separation method including a feed roller which rotates in a sheet feeding direction, a separation roller which is press-contacted to the feed roller with a predetermined pressure and a torque limiter which is coupled to the separation roller is disclosed in Japanese Patent Application Laid-open No. 5-338837.

Pressing force of the separation roller against the feed roller and a torque value of the torque limiter are set so that the separation roller is rotated to be driven by the feed roller or the sheet in a case that there is no sheet at a nip portion of the feed roller and the separation roller or a case that only one sheet is nipped. On the contrary, the pressing force of the separation roller and the torque value of the torque limiter are set so that the separation roller is reversely rotated in a case that a plurality of sheets are introduced into the nip portions of the feed roller and the separation roller.

FIG. 7 is a view which illustrates the configuration of a sheet feeding apparatus in the related art including the sheet separating and feeding portion of the abovementioned retard separation method. A cassette 200 which accommodates (i.e., supports) sheets S, a downstream side-wall 203 in the sheet feeding direction of the cassette 200, an intermediate plate 201 which is arranged in the cassette 200 movably in the vertical direction are provided as illustrated in FIG. 7. The sheets S are mounted on the intermediate plate 201.

A pickup roller 129 feeds the top sheet Sa which is accommodated in the cassette 200. A retard roller 131 which is formed of ethylene-propylene-diene rubber (EPDM), for example, is press-contacted to a feed roller 130 which is formed of urethane, for example, by a spring which is not illustrated.

By press-contacting the retard roller 131 to the feed roller 130, a separation nip portion N is formed between the retard roller 131 and the feed roller 130 in a state that a surface of the retard roller 131 contacted to the feed roller 130 is compressed.

Here, the top sheet Sa sent by the pickup roller 129 is fed to the separation nip portion N which is formed with the feed roller 130 and the retard roller 131. A conveyance path 303 is formed with a conveyance guide 302 which is provided from the separation nip portion N to a pair of conveying rollers 305*a*, 305*b*.

In the sheet feeding apparatus of the related art, in order to perform sheet feeding, first, the pickup roller 129 is rotated and the top sheet Sa accommodated in the cassette 200 is conveyed to the separation nip portion N.

Then, in the case that only one sheet Sa is conveyed to the separation nip portion N, as illustrated in FIG. 8A, the driving of the retard roller 131 is discontinued due to operation of the torque limiter and the retard roller 131 is rotated along with the sheet Sa. Thus, the sheet Sa is passing through the conveyance path 303.

On the other hand, in the case that a plurality of sheets are conveyed to the separation nip portion N, the retard roller 131 is rotated in the opposite direction to the feed roller 130 without being rotated along with the feed roller 130 due to the operation of the torque limiter. Then, since the retard roller 131 is rotated in the direction opposite to the sheet conveying direction as mentioned above, only one sheet Sa which is contacted to the feed roller 130 is conveyed to the downstream side. Then, other sheets are returned to the upstream side in the sheet conveying direction by the retard roller 131 as illustrated in FIG. 8B. In this manner, overlapped sheet feeding can be prevented.

Here, in the sheet feeding apparatus and the image forming apparatus therewith in the related art, the feed roller 130 and the retard roller 131 are to be worn as usage time of the apparatus becomes long. Then, as the abrasion increases, there arises a case that the friction force between the sheet and the retard roller and the sum of the torque of the torque limiter and the rotation resistance of the retard roller satisfy expression 1 of the following.

The friction force between the sheet and the retard roller<The torque of the torque limiter+the rotation resistance of the retard roller (Expression 1)

In this case, when the sheet is conveyed to the separation nip portion N, the retard roller 131 is rested without being rotated along with the sheet which is sent by the feed roller 130. Namely, the retard roller 131 fails to be rotated along with the sheet. Here, even in the case that the retard roller 131 fails to be rotated along with the sheet, separating and conveying of the sheet is performed if following expression 2 is satisfied when one sheet is conveyed to the separation nip portion N.

The friction force between the feed roller and the sheet>The friction force between the sheet and the retard roller (Expression 2)

Further, even in the case that two or more sheets are conveyed to the separation nip portion N, the separating and conveying of the sheet is performed if following expression 3 is satisfied.

The friction force between the sheets<The friction force between the sheet and the retard roller (Expression 3)

Further, even in the state that failure of rotation of the retard roller 131 occurs, the friction force between the retard roller 131 and the feed roller 130 is larger than the friction force between the sheet and the retard roller 131, normally. Therefore, following expression 4 is satisfied. Since the retard roller 131 is rotated before the sheet enters into the separation nip portion N, the sheet is introduced and conveyed to the separation nip portion N.

The friction force between the feed roller and the retard roller>The torque of the torque limiter+the rotation resistance of the retard roller (Expression 4)

However, the abrasion of the retard roller 131 does not occur evenly. As usage time of the apparatus increases, the abrasion of the retard roller 131 increases at a specific part. Namely, the state of expression 1 occurs not at entire circumference of the roller and the abrasion is increased a little more at a part than at the other parts. Accordingly, the frequency of stopping of the rotation thereat becomes high. Then, when the rotation is stopped, the sheet is rubbed and the abrasion at the part is rapidly increased. Thus, the retard roller 131 is worn in part and cannot be rotated along with the sheet.

Here, when the image forming apparatus is rested, the retard roller 131 is rested in a state that the specific part of which abrasion is increased is opposed to and press-contacted to the feed roller 130. In this case, a hollow is generated at the specific part due to the press-contact force with the feed roller 130. When this state continues for a long time, the hollow at the specific part becomes large and the specific part is not resumed as illustrated in FIGS. 9A and 9B.

Here, when the hollow becomes large, the rotation resistance of the retard roller 131 is increased. When the feed roller 130 is rotated in this condition, the surface of the retard roller 131 is further trimmed. Then, in the case that the abovementioned phenomenon is repeated, the abrasion is increased and the hollow becomes large only at the specific part of the retard roller 131. As a result, decrease of the left side and increase of the right side of expression 1 are accelerated only at the specific part of the retard roller 131. Accordingly, a part which satisfies the relation of following expression 5 appears prematurely.

The friction force between the feed roller and the retard roller<The torque of the torque limiter+the rotation resistance of the retard roller (Expression 5)

As illustrated in FIG. 9A, when the specific part with the increased abrasion and hollow satisfies the expression, the retard roller 131 remains rested even though the feed roller 130 is rotated. Accordingly, as illustrated in FIG. 9B, the top end of the sheet S impinges to the circumference of the rested retard roller 131 and entering of the sheet S into the separation nip portion N is obstructed so that the sheet S is jammed. In this manner, when the hollow is generated at the retard roller 131, jamming of the sheet S occurs.

The present invention provides a sheet feeding apparatus and an image forming apparatus in which occurrence of a hollow at a retard roller (i.e., a separation roller) can be prevented.

SUMMARY OF THE INVENTION

The present invention provides a sheet feeding apparatus including a sheet separating and feeding portion which separates and feeds sheets one by one accommodated in a sheet accommodating portion. The sheet separating and feeding portion includes a feed roller which is rotated in a sheet feeding direction, and a separation roller which is arranged rotatably in the direction opposite to the sheet feeding direction and which forms a separation nip portion for separating the sheets one by one therebetween with the feed roller while being press-contacted to the feed roller and which is capable of rotating along with the feed roller. The feed roller is rotated by a predetermined amount so as to rotate the separation roller after job completion.

In the present invention, the press-contacting position between the separation roller and the feed roller is shifted by rotating the feed roller by the predetermined amount so as to rotate the separation roller after the job completion. Therefore, generation of a hollow in part of the separation roller can be prevented. Accordingly, sheet entry to the separation nip portion without resting of the separation roller can be reliably performed so that sheet separating and feeding can be stably performed.

Further features of the present invention will become apparent from the following description of exemplary embodiments with reference to the attached drawings.

DESCRIPTION OF THE EMBODIMENTS

Figure 1:
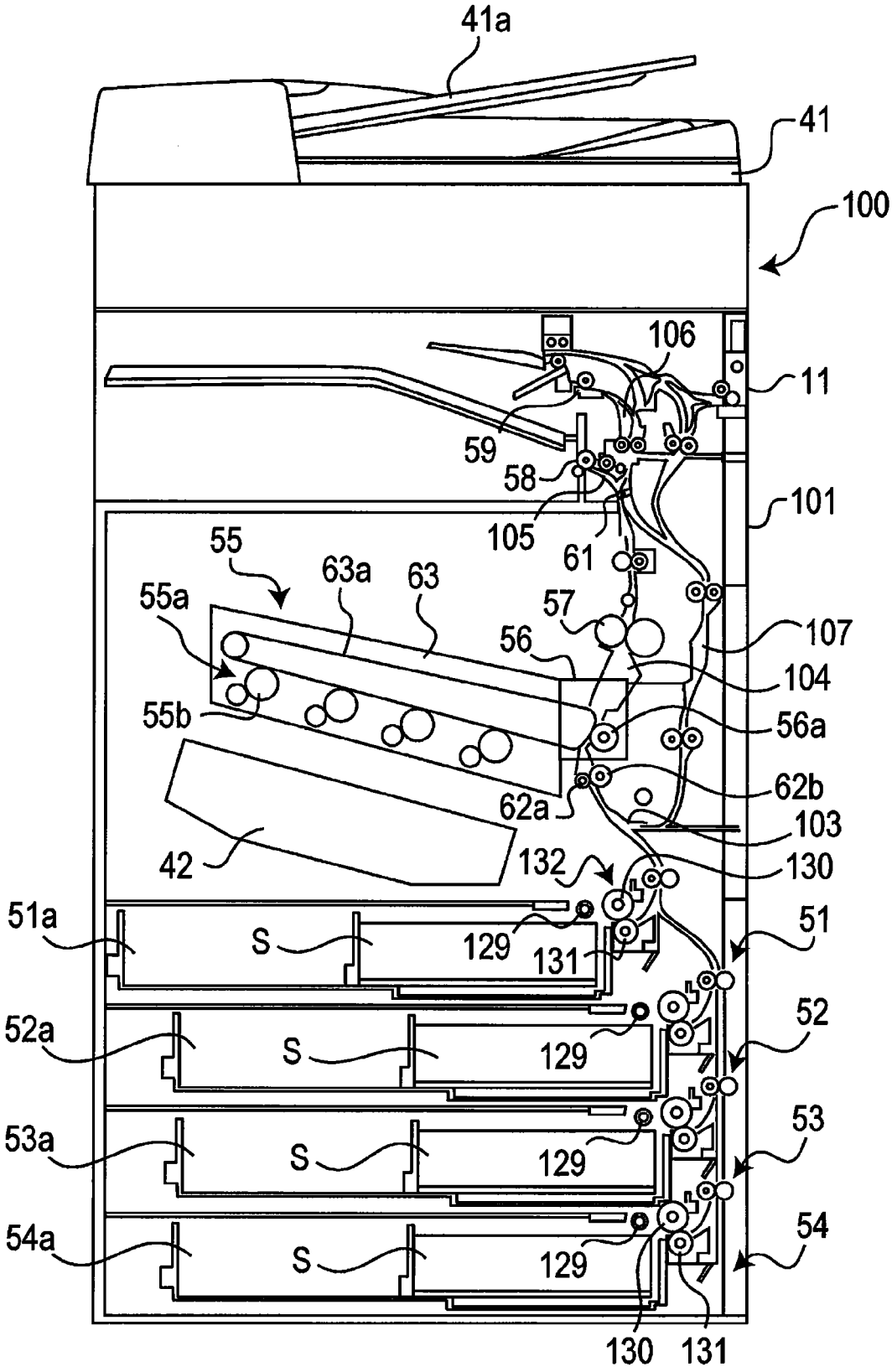
FIG. 1 is a schematic view which illustrates the configuration of a printer as an example of an image forming apparatus including a sheet feeding apparatus according to an embodiment of the present invention.

In the following, preferred embodiments to achieve the present invention are described in detail with reference to the drawings. FIG. 1 is a schematic view which illustrates the configuration of a printer as an example of an image forming apparatus including a sheet feeding apparatus according to the embodiment of the present invention.

A printer 100 and a printer body 101 are illustrated in FIG. 1. An image reading portion 41 including an image sensor etc. which irradiates light to an original placed on a platen glass as an original placing platen and which converts the reflecting light into digital signals is provided at the upper part of the printer body 101. Here, the original of which image is to be read is conveyed onto the platen glass by an automatic original feeding device 41*a*.

Further, an image forming portion 55 and sheet feeding apparatuses 51 to 54 which feed sheets S to the image forming portion 55 are provided below the image reading portion 41. The image forming portion 55 is provided with a scanner unit 42 and four process cartridges 55*a* for forming toner images of four colors of yellow (Y), Magenta (M), cyan (C) and black (Bk). Further, the image forming portion 55 includes an intermediate transfer unit 63 which is arranged above the process cartridge 55*a*.

Here, each of the process cartridges 55*a* is respectively provided with a photosensitive drum 55*b* and the like. Further, the intermediate transfer unit 63 includes primary transfer rollers (not illustrated) which are arranged inside the intermediate transfer belt 63*a* and which abut to the intermediate transfer belt 63*a* at positions respectively opposed to the photosensitive drums 55*b*.

When positive transfer bias is applied to the intermediate transfer belt 63*a* by the primary transfer rollers, each of the color toner images having negative polarity on the photosensitive drum 55*b* is sequentially transferred to the intermediate transfer belt 63*a* in a superimposed manner. Thus, a full-color image is formed on the intermediate transfer belt 63*a*.

A secondary transfer roller 56*a* which transfers the full-color image formed on the intermediate transfer belt 63*a* onto the sheet S is provided at a position opposed to the intermediate transfer belt 63*a* and structures a secondary transfer portion 56. Further, a fixing portion 57 is provided above the secondary transfer roller 56*a*.

The sheet feeding apparatuses 51 to 54 respectively includes cassettes 51*a* to 54*a*. Further, a pickup roller 129 for feeding the sheet S which is supported (accommodated) in each of the cassettes 51*a* to 54*a* is provided to each of the sheet feeding apparatuses 51 to 54.

Figure 3:
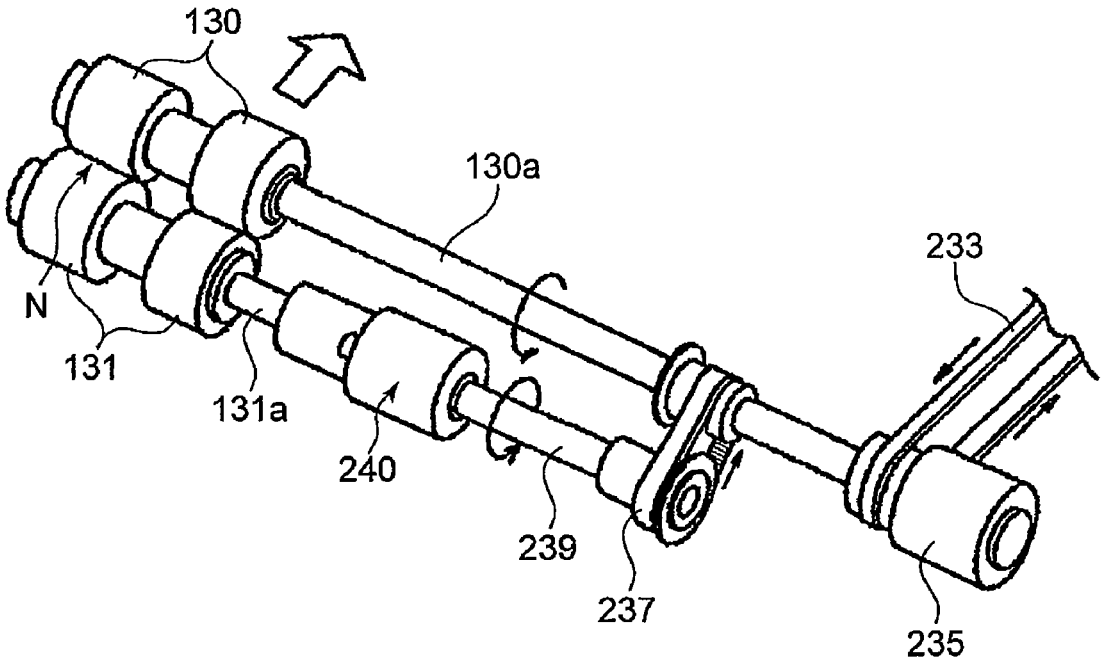
FIG. 3 is a view which illustrates the configuration of a drive transmitting mechanism of a sheet separating and feeding portion provided at the sheet feeding apparatus.

In addition, as illustrated in FIG. 3, a sheet separating and feeding portion 132 is provided to each of the sheet feeding apparatuses 51 to 54 for separating the top sheet S which is sent by the pickup roller 129.

The sheet separating and feeding portion 132 is configured with a feed roller 130 for conveying the sheet in the sheet feeding direction and a retard roller 131 as a separation roller which is capable of being rotated in the direction opposite to the sheet feeding direction. Here, the retard roller 131 is press-contacted to the feed roller 130 with a spring (not illustrated). Accordingly, the retard roller 131 is capable of rotating along with the feed roller 130 while forming a separation nip portion N therebetween with the feed roller 130.

The pickup roller 129 is supported by a bracket (not illustrated) which is rotatably supported to a shaft of the feed roller 130. Then, the bracket is rotated by a pickup roller lifting and lowering portion 232 (illustrated in FIG. 4) which has an actuator such as a solenoid (not illustrated). Accordingly, the pickup roller 129 is movable between a position at which being press-contacted to the upper surface of the sheet which is accommodated in the cassette and a position at which being apart from the sheet. Further, the pickup roller 129 is rotated by the driving of a roller shaft 130*a* of the feed roller 130 transmitted via a drive transmitting member such as a belt (not illustrated).

Figure 2:
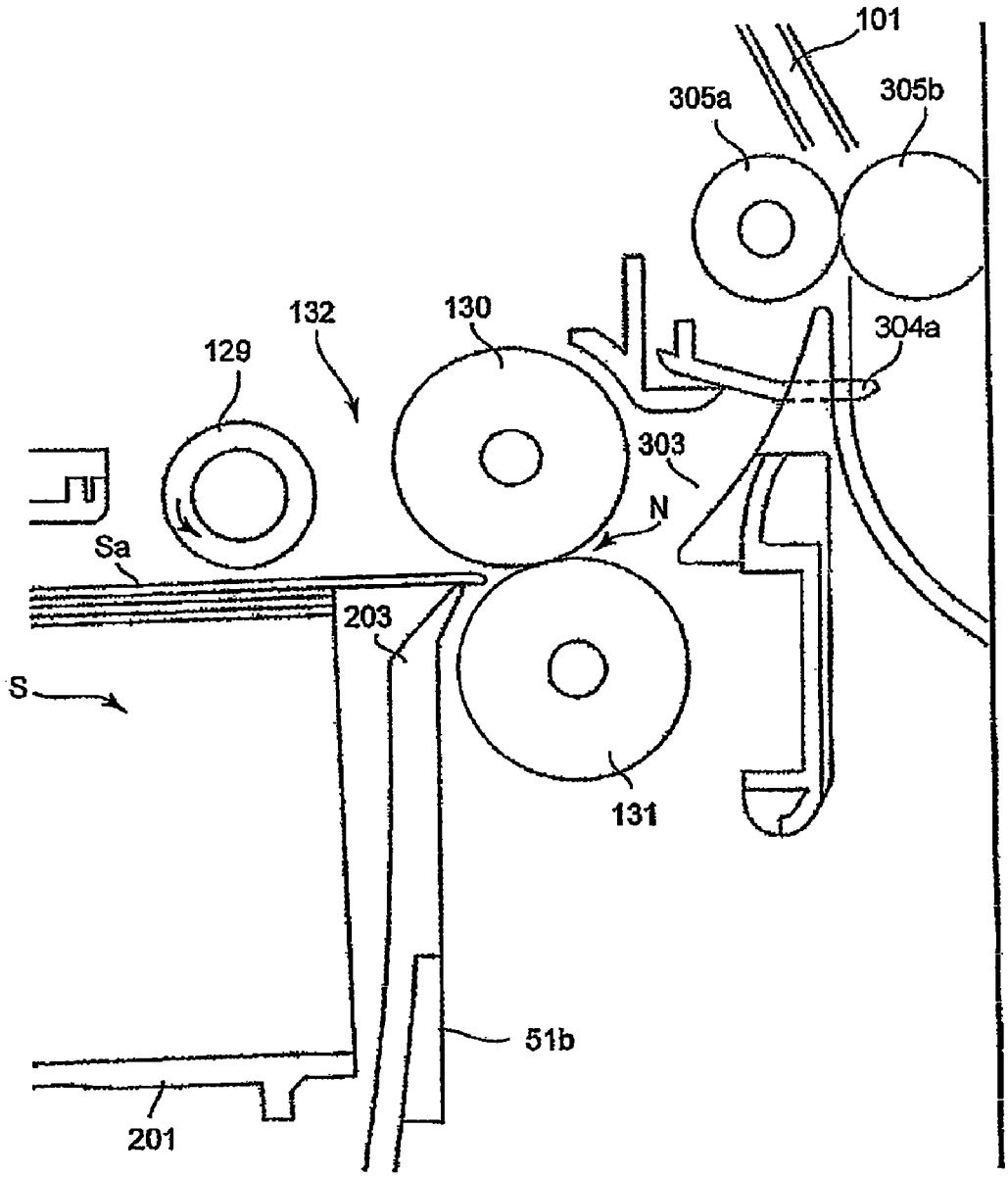
FIG. 2 is an explanatory view which illustrates the sheet feeding apparatus.

A downstream side-wall 203 in the sheet feeding direction of each of the cassettes 51*a* to 54*a* and a sensor lever 304*a* of a sheet feed sensor 304 as a detection portion (illustrated in FIG. 4) which detects sheet passing are illustrated in FIG. 2. The detection portion of the present invention is configured with the sheet feed sensor 304 and a control portion 300 which determines the sheet passing based on a signal from the sheet feed sensor 304.

As illustrated in FIG. 1, a conveyance path 103 conveys the sheets S fed from the cassettes 51*a* to 54*a* to a transfer portion 56. Conveyance paths 104 to 106 are respectively paths from the transfer portion 56 to a flapper 61 via the fixing portion 57, from the flapper 61 to a discharge portion 58, and from the flapper 61 to a discharge portion 59.

A re-conveyance path 107 guides the sheet to the image forming portion 55 once more while reversing the front and back side of the sheet for forming an image on the back surface of the sheet to which an image is previously formed at the front surface by the image forming portion 55. A door 11 structures a part of the conveyance paths 103 to 106. A sheet jammed at each of the conveyance paths can be removed with the door 11 opened.

Next, image forming operation of the abovementioned printer 100 is described.

When the image forming operation is started, the scanner unit 42 irradiates laser light (not illustrated) based on image information from a personal computer (not illustrated) etc. so that the surface of the photosensitive drum 55*b* of which surface is evenly charged at predetermined polarity and potential is sequentially exposed. Thus, electrostatic latent images are formed on the photosensitive drum 55*b*. Subsequently, the electrostatic latent images are developed respectively with toner of yellow (Y), magenta (M), cyan (C) and black (Bk) and are visualized to be respective toner images of yellow (Y), magenta (M), cyan (C) and black (Bk).

Then, each of the color toner images is sequentially transferred to the intermediate transfer belt 63*a* with the primary transfer bias applied to the primary transfer roller. Accordingly, a full-color toner image is formed on the intermediate transfer belt 63*a*.

Being concurrent to the toner image forming operation, the pickup roller 129 conveys the top sheet Sa of the sheets S accommodated in one of the cassettes 51*a* to 54*a* to the separation nip portion N of the feed roller 130 and the retard roller 131. The sheet Sa sent to the separation nip portion N is further conveyed by the feed roller 130 and the retard roller 131 which is rotated along with the feed roller 130 and the sheet Sa.

Then, the sheet Sa passes through the conveyance path 303 and arrives at a pair of conveying rollers 305*a*, 305*b* after detection signal is outputted by the sheet feed sensor 304 by rotating the sheet feed sensor lever 304*a*. Further, the sheet Sa nipped by the pair of conveying rollers 305*a*, 305*b* is sent to the conveyance path 101. The top end position of the sheet Sa is adjusted by abutting to a pair of registration rollers 62*a*, 62*b* which are resting.

Next, the pair of registration rollers 62*a*, 62*b* are driven at the timing to match the positions of the full-color toner image on the intermediate transfer belt 63*a* and sheet Sa at the secondary transfer portion 56. Accordingly, the sheet Sa is conveyed to the secondary transfer portion 56. Then, the full-color toner image is transferred onto the sheet Sa all together at the secondary transfer portion 56 with secondary transfer bias applied to the secondary transfer roller 56*a*.

Next, the sheet Sa onto which the full-color toner image is transferred as described above is conveyed to the fixing portion 57. At the fixing portion 57, the toner of every color is melted and mixed by receiving heat and pressure so as to be fixed on the sheet Sa as a full-color image. Subsequently, the sheet Sa onto which the image is fixed is discharged by either of the discharge portions 58, 59 which are provided downstream the fixing portion 57.

FIG. 3 is a view which illustrates the configuration of a drive transmitting mechanism of the sheet separating and feeding portion 132. The driving of a later-mentioned drive motor in FIG. 4 which is provided in the printer body 101 is transmitted to the roller shaft 130*a* of the feed roller 130 via a drive belt 233 and an electromagnetic clutch 235. Then, the driving transmitted to the roller shaft 130*a* is transmitted to a transit shaft 239 via a timing belt 237, and then, is further transmitted to a roller shaft 131*a* of the retard roller 131 via a torque limiter 240.

Here, when a sheet feeding signal is inputted and the sheet feeding operation is started, the electromagnetic clutch 235 is controlled to be ON. Accordingly, the retard roller 131 is driven to rotate in the direction opposite to the sheet feeding direction while the feed roller 130 is driven to rotate in the sheet feeding direction. Thus, the sheets S other than the top sheet Sa which are fed by the pickup roller 129 is returned by the retard roller 131. In this manner, only one sheet at the top is sent to the separation nip portion N.

When the sheet is at some midway of being further conveyed downstream after being separated and arriving at the pair of conveying rollers 305*a*, 305*b*, the electromagnetic clutch 235 is controlled to be OFF before the rear end of the sheet arrives at the separation nip portion N of the feed roller 130 and the retard roller 131. Accordingly, the sheet is conveyed by the pair of the conveying roller 305*a*, 305*b*. The feed roller 130 and the retard roller 131 are rotated along with the sheet and are to be rested. The resting state continues until the next sheet feeding signal is inputted. When the next sheet feeding signal is inputted, the electromagnetic clutch 235 is controlled to be ON and the next sheet feeding operation is performed.

Figure 4:
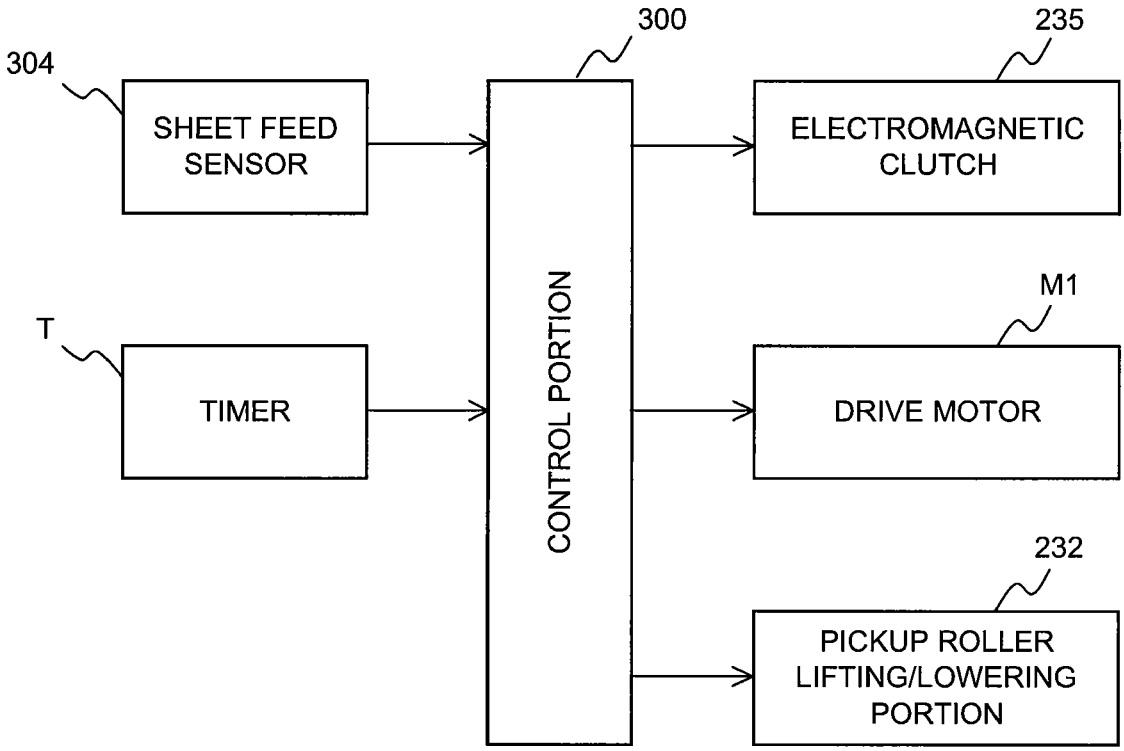
FIG. 4 is a control block diagram for controlling driving of the sheet separating and feeding portion.

FIG. 4 is a control block diagram for controlling the driving of the sheet separating and feeding portion 132. As illustrated in FIG. 4, the detection signal of the sheet feed sensor 304 and time measurement information from a timer T are inputted to a control portion 300. The control portion 300 drives the electromagnetic clutch 235, a drive motor M1, and the pickup roller lifting and lowering portion 232 based on the detection signal of the sheet feed sensor 304 and the time measurement information from the timer T.

Here, as described above, abrasion at a specific part of the retard roller 131 is increased as usage time of the apparatus is increased. Normally, when the electromagnetic clutch 235 is controlled to be OFF, the retard roller 131 is rotated along with the sheet. However, when being in the state of expression 1 which is described in the description of the related art due to the increased abrasion, the retard roller 131 stops without being rotated along with the sheet. Namely, when the specific part at which the abrasion is increased is opposed to the sheet at the time of sheet separating and feeding, the retard roller 131 stops thereat. Then, when the sheet feeding operation is completed, the specific part is continuously opposed to the feed roller 130.

As described above, for example, the feed roller 130 is formed of EPDM and the retard roller 131 is formed of urethane which is the material of which hardness is low. Therefore, the hardness of the surface of the retard roller 131 is lower than that of the feed roller 130.

Figure 9A:
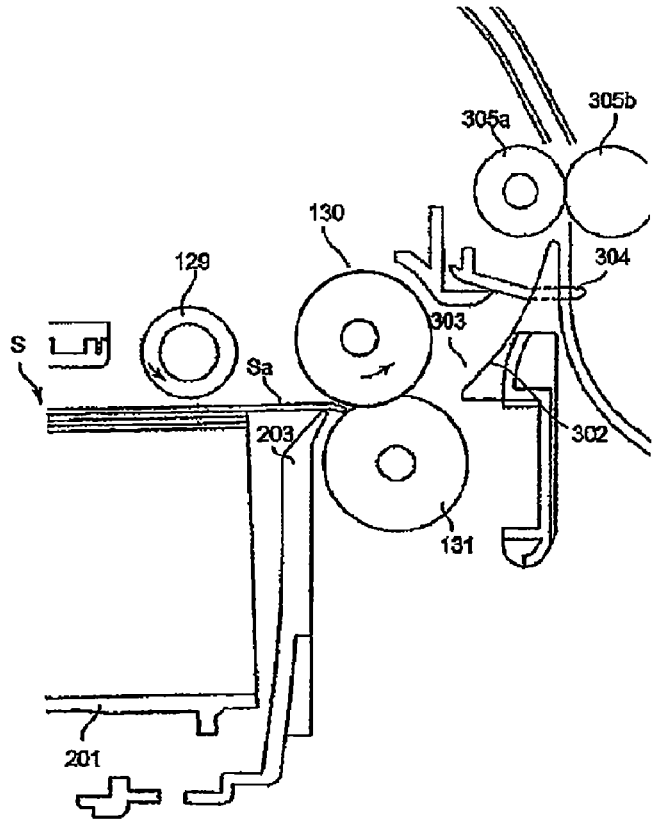
FIG. 9A PRIOR ART
FIGS. 9A and 9B are explanatory views which illustrate the sheet feeding operation of the sheet feeding apparatus in the related art.
Figure 9B:
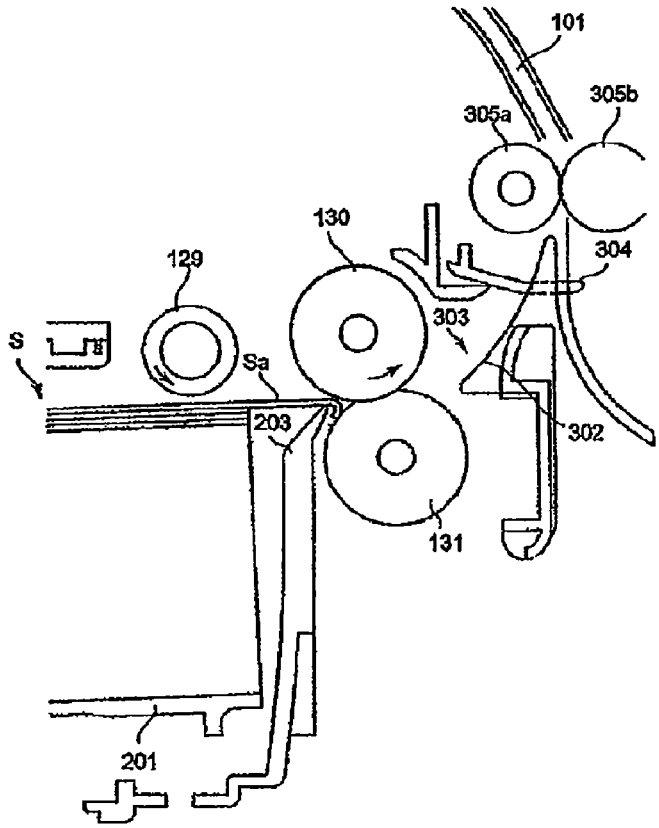
FIG. 9B PRIOR ART

Therefore, when the retard roller 131 is press-contacted to the feed roller 130, the separation nip portion N is formed between the retard roller 131 and the feed roller 130 in the state that a part of the surface of the retard roller 131 contacted to the feed roller 130 is compressed. Then, for example, in a case that usage of the printer is discontinued, when the retard roller 131 is rested in the state that the specific part is press-contacted to the feed roller 130 and the press-contacting is continued for a long time, a large hollow is generated at the specific part as illustrated in FIG. 9.

In the present embodiment, the feed roller 130 is rotated by a predetermined amount after job completion, for example, so that a hollow in part is not to be generated at the specific part even when the retard roller 131 is rested in the state that the specific part at which the abrasion is increased is press-contacted to the feed roller 130. By rotating the feed roller 130 by the predetermined amount (i.e., subsequent rotation), the retard roller 131 stops without being press-contacted to the feed roller 130 at the specific part thereof. As a result, the large hollow is not generated even when the printer is resting for a long time thereafter.

Here, the predetermined amount of rotation for the subsequent rotation only needs to be set so that the press-contacted position between the retard roller 131 and the feed roller 130 is to be slightly shifted from the hollowed part at the time of resting. In a case that the predetermined amount of the rotation is set large to shift the position largely, the next sheet which has been introduced to the separation nip portion N is to be sent largely from the separation nip portion N. In this case, there is a risk that the largely sent sheet is broken by being hit to the printer body 101 when deriving the cassette.

In the present embodiment, since the rotation is promptly stopped when the sheet feed sensor 304 arranged at the vicinity of the separation nip portion N is controlled to be on, over-sending of the sheet can be prevented. Therefore, the abovementioned problem can be prevented.

Figure 5:
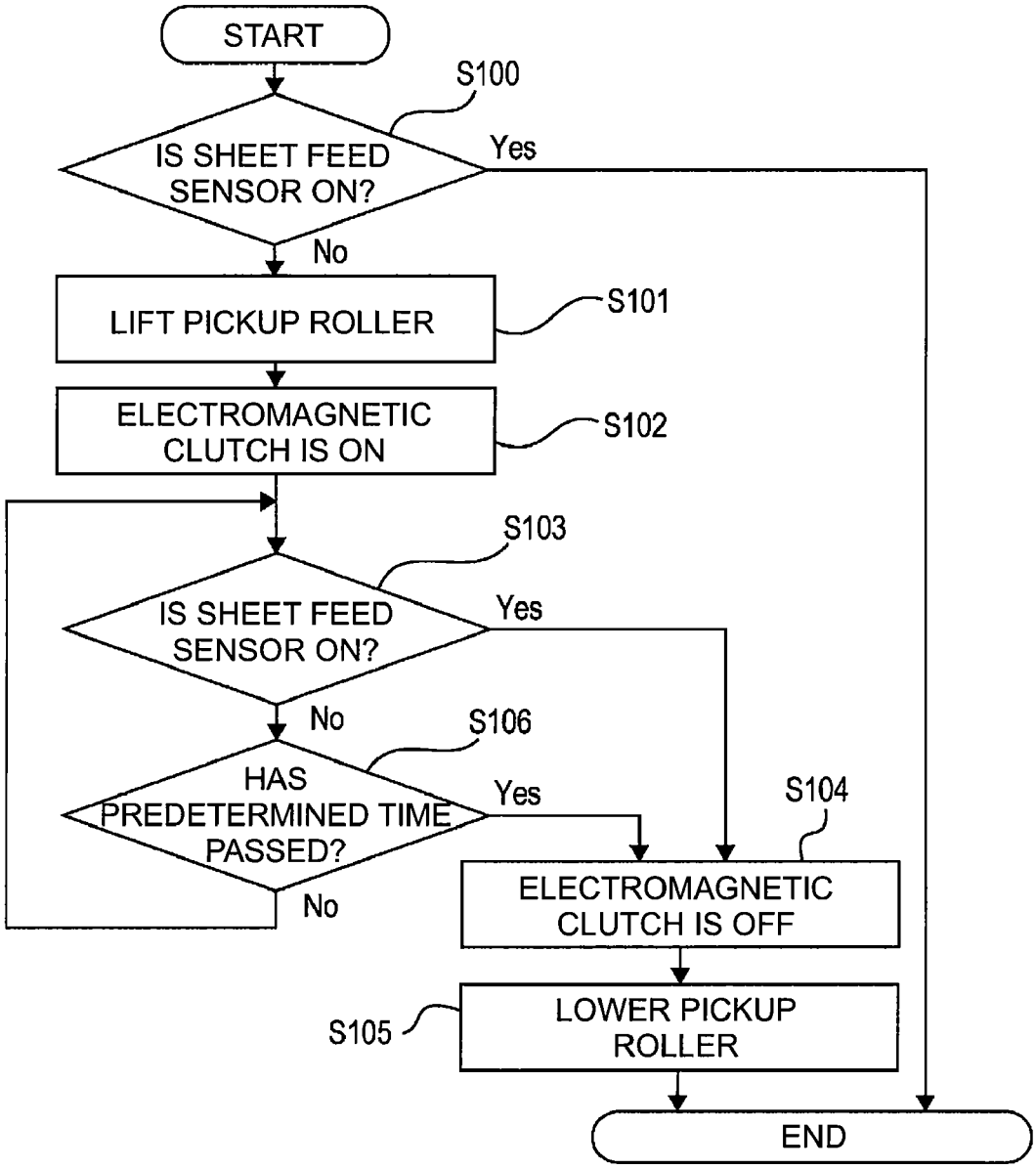
FIG. 5 is a flowchart which describes drive control after job completion of the sheet separating and feeding portion.

Next, the drive control at the subsequent rotation of the sheet separating and feeding portion 132 after job completion is described with reference to the flowchart of FIG. 5 and the timing chart of FIG. 6. Here, in the present invention, the job completion includes completion of the sheet separating and feeding operation at the sheet separating and feeding portion 132. Further, it is possible to perform the subsequent rotation before the image forming operation at the image forming portion is completed when the rear end of the last sheet departs from the separation nip portion N after the electromagnetic clutch 235 becomes OFF.

When the job is completed, first, the control portion 300 determines whether or not the sheet arrives at the sheet feed sensor 304 based on the signal from the sheet feed sensor 304. In the present embodiment, when the sheet arrives at the sheet feed sensor 304, the sheet feed sensor 304 becomes ON since the sheet feed sensor lever 304*a* is pressed. Therefore, first, the control portion 300 determines whether or not the sheet feed sensor 304 is ON in step S100.

Here, when the sheet feed sensor 304 is ON (i.e., "Y" in step S100), the feed roller 130 is not subsequently rotated since the sheet has already arrived at the sheet feed sensor 304. On the other hand, when the sheet feed sensor 304 is OFF (i.e., "N" in step S100), the pickup roller 129 is lifted by driving the pickup roller lifting and lowering portion 232 in step S101 so as not to feed the sheet by being rotated to receive the driving of the roller shaft 130*a* of the feed roller 130. The sheet is to be apart from the pickup roller 129 by lifting the pickup roller 129. Therefore, even when the feed roller 130 is rotated by receiving the driving of the roller shaft 130*a*, the sheet is not to be fed.

Figure 6A:
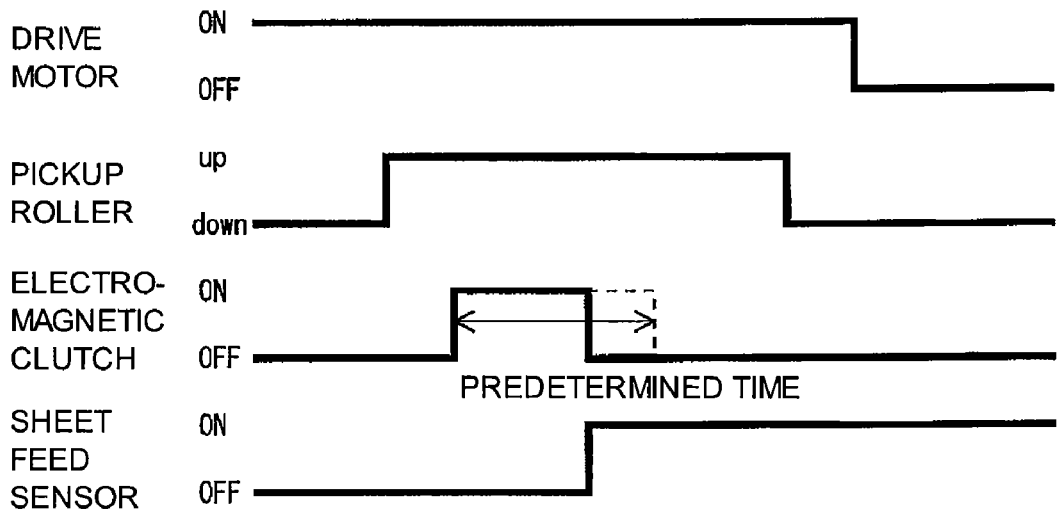
FIGS. 6A and 6B are timing charts which describe the drive control after the job completion of the sheet separating and feeding portion.
Figure 6B:
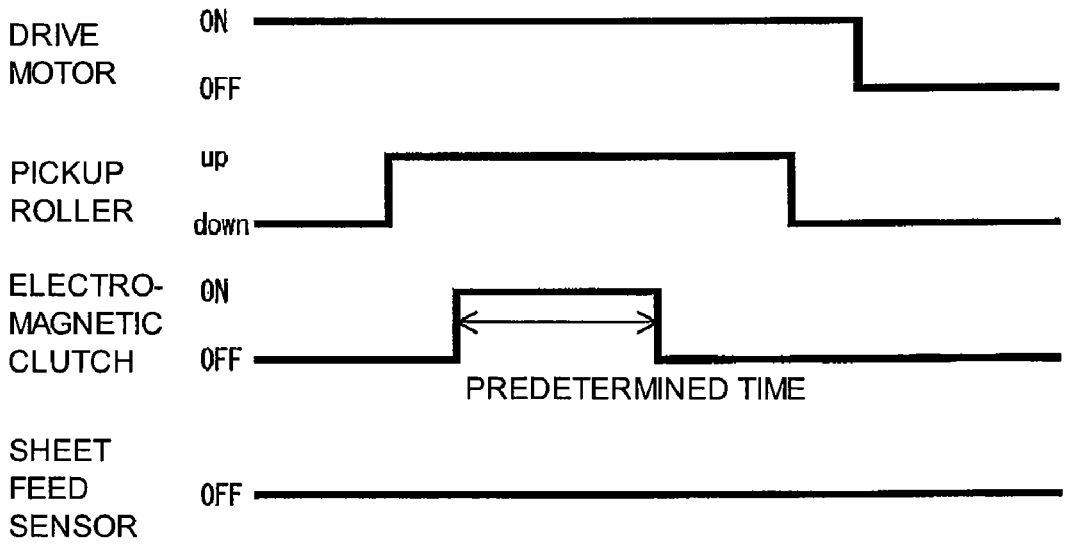
Figure 7:
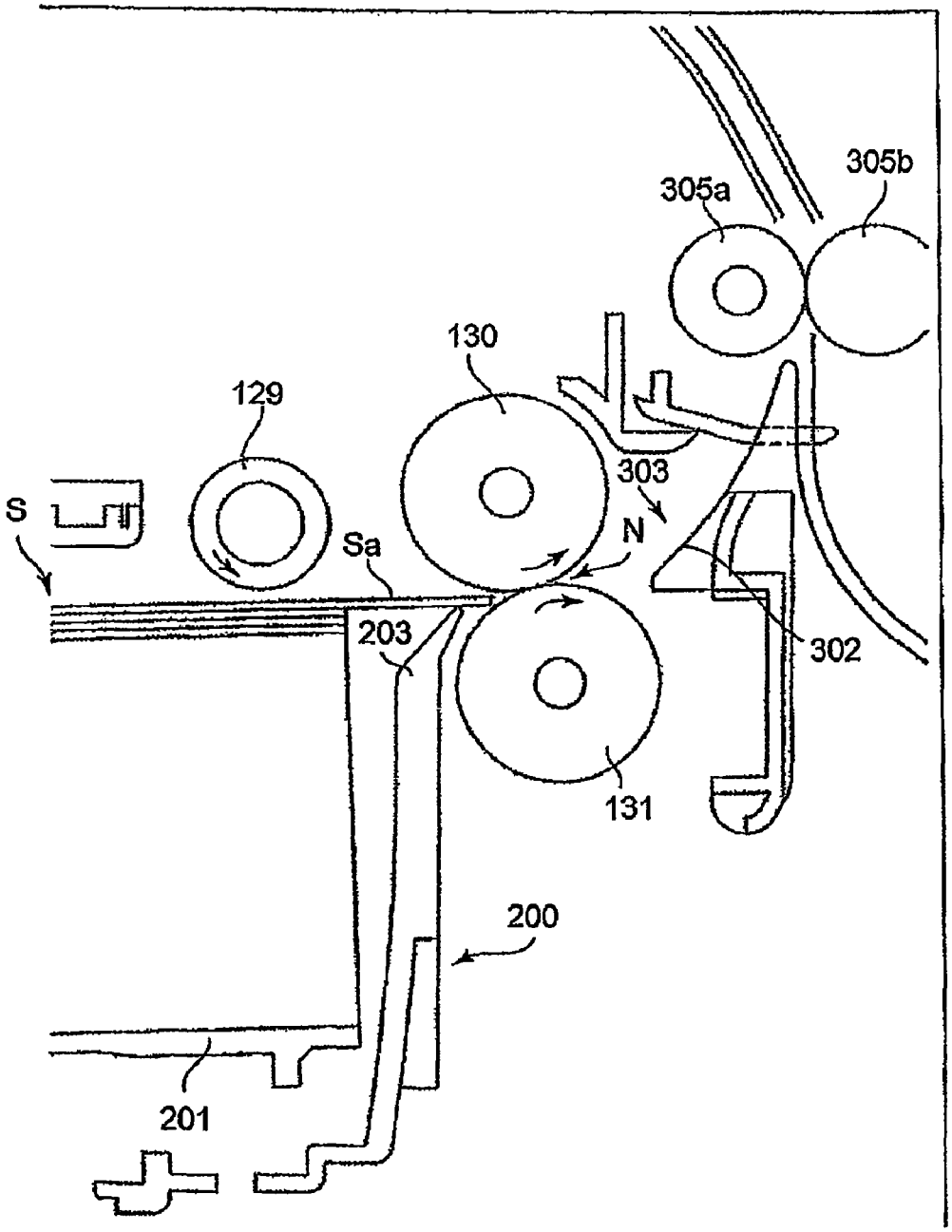
FIG. 7 PRIOR ART
FIG. 7 is a view which illustrates the configuration of a sheet feeding apparatus in the related art.
Figure 8A:
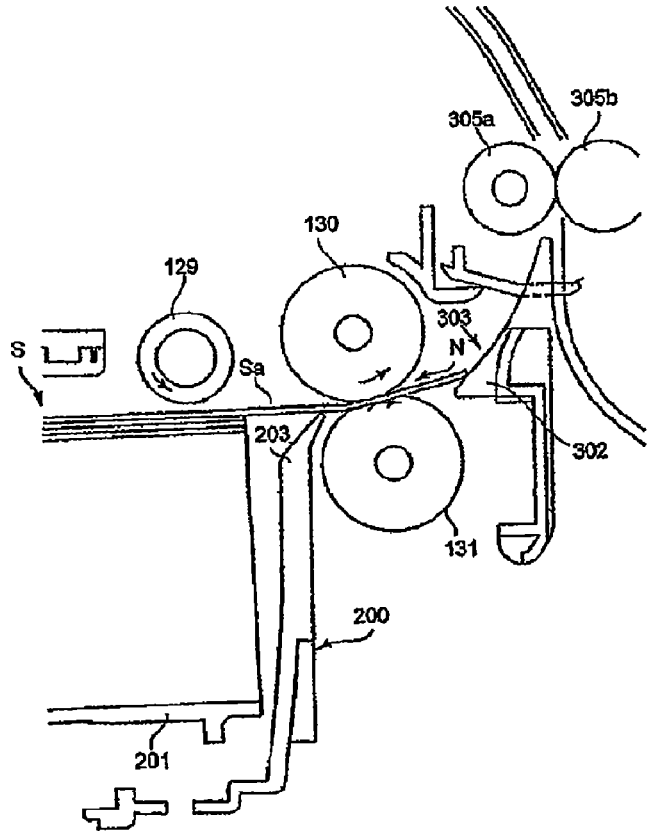
FIG. 8A PRIOR ART
FIGS. 8A and 8B are explanatory views which illustrate sheet feeding operation of the sheet feeding apparatus in the related art.
Figure 8B:
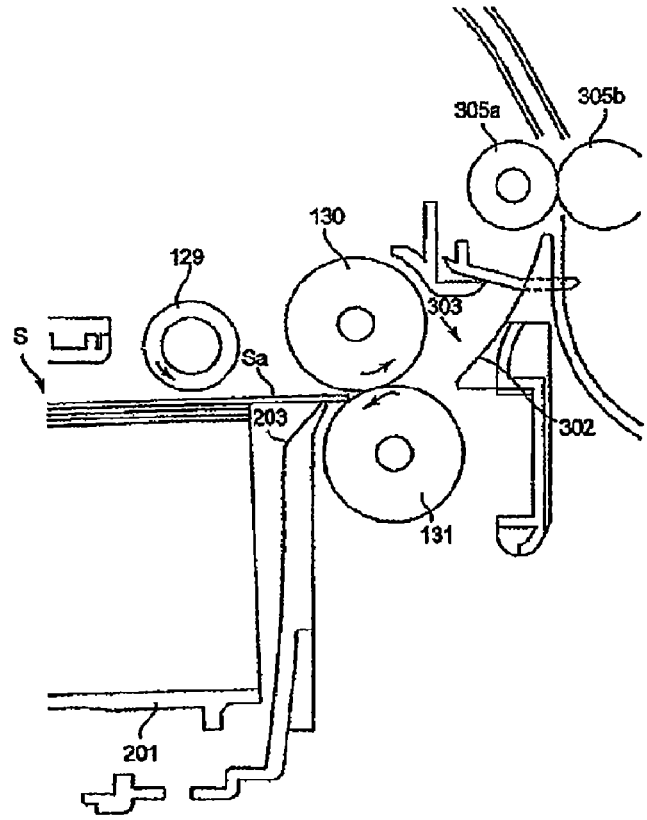
FIG. 8B PRIOR ART

Next, the electromagnetic clutch 235 is to be ON at predetermined timing in step S102 so as to rotate the feed roller 130 for a predetermined time. Then, the retard roller 131 is rotated with the rotation of the feed roller 130. In a case that the sheet is previously engaged at the feed roller 130 after the job completion, the sheet is to be fed by the rotation. Therefore, as illustrated in FIG. 6A, when the sheet feed sensor 304 is to be ON by detecting the fed sheet ("Y" in step S103), the electromagnetic clutch is to be OFF in step S104. Subsequently, in preparation for the next sheet feeding, the pickup roller 129 is lowered in step S105 by driving the pickup roller lifting and lowering portion 232. In a case that the sheet feed sensor 304 does not detect a sheet and does not become ON even with the rotation of the feed roller 130 ("N" in step S103), the feed roller 130 is rotated for the predetermined time based on the time measurement information from the timer T. For example, as illustrated in FIG. 6B, when there is no sheet at the separation nip portion N, the sheet feed sensor 304 does not detect a sheet even after the predetermined time ("Y" in step S106). Then, the electromagnetic clutch 235 is to be OFF in step S104. Subsequently, in preparation for the next sheet feeding, the pickup roller 129 is lowered in step S105 by driving the pickup roller lifting and lowering portion 232.

In this manner, in the present embodiment, the press-contacting position between the retard roller 131 and the feed roller 130 can be shifted by performing the subsequent rotation of the feed roller 130 by the predetermined amount so as to rotate the retard roller 131 after the job completion. Accordingly, the retard roller 131 can be prevented from resting in the state that the specific part thereof is continuously press-contacted to the feed roller 130. As a result, generating of a hollow at the retard roller 131 can be prevented and sheets can be stably separated and fed. Further, the lifetime of the retard roller 131 can be prolonged and cost reduction can be achieved.

Here, the present embodiment adopts the retard roller separation method in which the sheets are fed by the pickup roller from the cassette and separated one by one between the feed roller and the retard roller. However, the present invention is not limited to this. For example, it is also possible to adopt a retard roller separation method in which the sheets are fed by the feed roller from the cassette and separated by the retard roller which is press-contacted to the feed roller without using the pickup roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-206041, filed Aug. 8, 2008, which is hereby incorporated by reference herein in its entirety.

What is claimed is:

1. A sheet feeding apparatus including a sheet separating and feeding portion which separates and feeds sheets one by one accommodated in a sheet accommodating portion, the sheet separating and feeding portion comprising:

a pickup roller which feeds out a sheet accommodated by the accommodating portion;

a feed roller which is rotated in a sheet feeding direction to feed the sheet fed out by the pickup roller;

a separation roller which is arranged rotatably in the direction opposite to the sheet feeding direction, and which forms a separation nip portion for separating the sheets one by one therebetween with the feed roller while being press-contacted to the feed roller and which is capable of rotating along with a rotation of the feed roller;

a drive portion which rotates the feed roller;

a control portion which controls the drive portion to rotate the feed roller by a predetermined amount without feeding the sheet by the pickup roller so as to rotate the separation roller before a next job starts after a last sheet of a job is fed from the sheet accommodating portion; and a detection portion arranged immediately downstream in the sheet feeding direction of the feed roller and which is configured to detect the sheet fed by a rotation of the feed roller by the predetermined amount, wherein the control portion controls the drive portion to stop a rotation of the feed roller by less than the predetermined amount after the last sheet of the job is fed in a case that the sheet is detected by the detection portion and the control portion controls the drive portion to rotate the feed roller by the predetermined amount in a case that the sheet is not detected previously.

2. The sheet feeding apparatus according to claim 1, wherein the surface of the separation roller is formed of a material of which hardness is lower than that of the feed roller.

3. The sheet feeding apparatus according to claim 1, wherein the pickup roller sends the sheet to the separation nip portion of the feed roller and the separation roller; and wherein the sheet separating and feeding portion further includes:

a lifting and lowering portion which lifts and lowers the pickup roller, wherein the control portion controls the lifting and lowering portion to move the pickup roller to be apart from the sheet accommodated in the sheet accommodating portion when the feed roller is rotated by the predetermined amount after the last sheet of the job is fed.

4. An image forming apparatus including a sheet feeding apparatus and an image forming portion which forms an image on a sheet which is fed from the sheet feeding apparatus, the sheet feeding apparatus comprising:

an accommodating portion which accommodates the sheets;

a pickup roller which feeds out a sheet accommodated by the accommodating portion;

a feed roller which is rotated in a sheet feeding direction to feed the sheet fed out by the pickup roller;

a separation roller which is arranged rotatably in the direction opposite to the sheet feeding direction, and which forms a separation nip portion for separating the sheets fed from the sheet accommodating portion one by one therebetween with the feed roller while being press-contacted to the feed roller and which is capable of rotating along with a rotation of the feed roller;

a drive portion which rotates the feed roller;

a control portion which controls the drive portion to rotate the feed roller by a predetermined amount without feeding the sheet by the pickup roller so as to rotate the separation roller before a next job starts after a last sheet of a job is fed from the sheet accommodating portion; and a detection portion arranged immediately downstream in the sheet feeding direction of the feed roller and which is configured to detect the sheet fed by a rotation of the feed roller by the predetermined amount, wherein the control portion controls the drive portion to stop a rotation of the feed roller by less than the predetermined amount after the last sheet of the job is fed in a case that the sheet is detected by the detection portion and the control portion controls the drive portion to rotate the feed roller by the predetermined amount in a case that the sheet is not detected previously.

5. The image forming apparatus according to claim 4, wherein the surface of the separation roller is formed of a material of which hardness is lower than that of the feed roller.

6. The image forming apparatus according to claim 4, wherein the pickup roller sends the sheet to the separation nip portion of the feed roller and the separation roller, and wherein the sheet feeding apparatus further includes:

a lifting and lowering portion which lifts and lowers the pickup roller, wherein the control portion controls the lifting and lowering portion so as to move the pickup roller to be apart from the sheet accommodated in the sheet accommodating portion when the feed roller is rotated by the predetermined amount after the last sheet of the job is fed.

* * * * *